United States Patent [19]

Wilson, Jr.

[11] Patent Number: 5,022,379

[45] Date of Patent: Jun. 11, 1991

[54] COAXIAL DUAL PRIMARY HEAT EXCHANGER

[76] Inventor: James C. Wilson, Jr., 28251 Georgetown Rd., Salem, Ohio 44460

[21] Appl. No.: 523,064

[22] Filed: May 14, 1990

[51] Int. Cl.[5] ..... F24H 3/00

[52] U.S. Cl. ..... 126/116 R; 126/109; 126/194; 126/390; 126/99 A; 165/154

[58] Field of Search ..... 126/116 R, 99 R, 104 R, 126/390, 391, 392, 361, 350 R, 99 A, 109; 122/44 R, 250 R, 250 J; 165/154, 156

[56] References Cited

U.S. PATENT DOCUMENTS

| | | | |
|---|---|---|---|
| 3,177,865 | 4/1965 | Jones et al. | 126/109 |
| 4,905,661 | 3/1990 | Wilson, Jr. | 126/99 A |
| 4,909,191 | 3/1990 | Le Mei | 126/361 X |

*Primary Examiner*—Larry Jones
*Attorney, Agent, or Firm*—George W. Dishong

[57] ABSTRACT

Basically the present invention in its most simple form or embodiment is directed to a heat exchanger which provides for at least two heat exchange surfaces and which has the combustion of the fuel, which generates the heat, take place within the heat exchanger rather than the heat of combustion being introduced into the exchanger from an external combustion chamber and wherein the flame is directed into an opening of a truncated cone which cone has a shape approximating the shape of the flame and wherein the tips or ends of the flame "play" on an arcuate surface which is in thermal energy transfer communication with fluid to be heated which is at the unheated or ambient temperature. Additionally, note that the fluid, air in the case of a hot air system, is introduced into the passages where heat exchange will take place, and directed toward the hottest region of the combustion chamber. That is, the coldest air comes into thermal contact with the hottest region providing for maxinum heat exchange. The flame is introduced into the combustion chamber in a direction which is essentially parallel to the axis of the cylindrical device. As a consequence the flame does not impinge onto any substantially flat or planar surface. Because of the nature of the construction of the nozzle etc., the flame forms into a cone configuration allowing thorough mixture with the combustion air and thus providing for complete and efficient combustion. The structural details and the pressures that are developed within the combustion chamber and the combustion region, cause the flame to "play" along the conically configured walls of the truncated portion defining the combustion chamber and to impinge onto the curved/arcuate surface which conductively transfers heat to the air or fluid entering the first heat exchange volume or space. The heat of the combustion gases is given up to the fluid in basically (5) heat exchange volumes of the device.

10 Claims, 3 Drawing Sheets

COAXIAL DUAL PRIMARY HEAT EXCHANGER

BACKGROUND OF THE INVENTION

1. Field of the Invention

This invention most generally relates to a heat exchanging device for heating a fluid such as air and is more particularly concerned with providing heated air by conduction of heat, at a plurality of locations, from a combustion gas space to the fluid. The combustion passage is substantially coextensive with but is not in air mixing communication with the fluid to be heated or the plurality of volumes wherein heat transfer occurs. Even more particularly the invention relates to a heat exchanging device for heating air wherein the combustion region is defined by two concentric cylindrically configured heat exchange surfaces, one surface being the inner shell of a coaxial heat exchange member and the other surface being an outer shell of the coaxial heat exchange member. The combustion chamber is contained within the heat exchanger and is defined by a truncated cone portion of the coaxial member and has an arcuate surface upon which a flame strikes and side walls which taper from a small circumference to a larger circumference creating a chamber having a cone configuration which taper approximates the cone shape of a flame emanating from a flame producing nozzle.

2. Description of the Prior Art

It would be desirable and advantageous to have a heat exchange device which would be capable of burning waste oil products efficiently and in a manner which would allow easy cleaning of the burner unit and the heat exchanger. It would also be desirable to have a unit or device which has the combustion take place within the heat exchanger instead of in a chamber removed from the heat exchange region. It is also important that the combustion flame not impinge directly onto a surface causing deposits to form which may result in the incomplete and inefficient burning of the fuel. It is also important that the gases of combustion be kept separate and in a non-mixing relationship and that these hot combustion gases be directed in such a manner as to encounter large surfaces which are in thermal contact with turbulent fluid, such as air or water, which is to be heated. To improve or enhance the efficiency of thermal energy transfer from the hot gases of combustion, the fluid should be turbulent close to the heat exchange surfaces.

In order to be able to burn waste oil products in an efficient and ecologically sound manner, it is critical that the combustion efficiency be within well defined specifications. It is required that the efficiency be not less than 75% as measured according to industry accepted standards of testing and that the residuals emitted be as completely oxidized as possible at this efficiency level. The maintenance must be low, the combustion efficiency high, and there must be high thermal energy transfer in order that the system be acceptable for such use. In particular, the design of a device for the burning (rapid oxidation) of contaminated waste oils should have a smooth uniform, constant, controlled flow of combustion gases throughout and there should be no abrupt direction changes of the gases while they are at the highest temperature, i.e., prior to the combustion gases giving up most of the heat to the fluid. This is necessary to uniformly deposit, within the device those noncombustibles inherently generated by this process. When this is accomplished the heat exchange degradation process is more nearly uniform preventing premature heat exchange loss in any given area.

It is also very important that the device can be quickly, easily and thoroughly cleanable. In the burning of waste oil those noncombustibles contained in the waste oil deposit in the combustion chamber. This material must be easily removed in order that the efficiency of the system be maintained.

The instant invention accomplishes such objectives. In accomplishing the objectives of efficient burning of waste oil, the device is also very effective and efficient and very maintenance free when burning conventional heating oil. Applicant is not aware of any heat exchanger devices or assemblies presently available which meet the necessary criteria for the proper and effective burning of waste oil products coupled with the ability to expose completely and in total all prime heating surfaces for necessary, periodical inspection and/or mechanical cleaning. Nor is Applicant aware of a device which incorporates all of these desirable features within the relatively small volumetric configuration possible with this invention. In fact Applicant is unaware of any such units available which have the advantages and characteristics described that burn regular fuels such as heating oil and/or gas.

Some inventions related to the instant invention and disclosed in the following United States Patents have been studied. The following is a brief description and discussion of these related inventions.

Wilson, U.S. Pat. No. 4,905,661 discloses cylindrical heat exchanger in which the flame is introduced into the device about perpendicular to the axis of the flow of both the combustion gases and the air which is being heated in the device. In the patented device, the combustion gases flow in a helical path around the inner shell through which air to be heated flows in an axial path through the device and the flame is introduced into the combustion chamber in a direction perpendicular to the axis of the heat exchanger.

Juhnke, U.S. Pat. No. 2,056,465 discloses a heater having a cylindrical shape and including a plurality of passageways for air flow therethrough, the passageways allowing contact with the combustion gases in a middle cylinder defined by the inner cylinder wall and an outer wall, the outer wall also in contact with the air and the combustion gases.

Tate, U.S. Pat. No. 483,819 discloses a hot air furnace which includes a central air passageway which contacts a middle cylinder containing the gases of combustion. The outer wall of the middle cylinder are also in contact with the air, providing two heated air masses.

Rice, U.S. Pat. No. 586,062 discloses a hot air furnace which includes a central jacket having a plurality of pipes having the shape of the frustrum of a cone. These pipes and the outer wall of the jacket radiate heat to the air masses outside the central jacket.

Muckelrath, U.S. Pat. No. 3,388,697 discloses an enlarged air heater for discharging large volumes of heated air toward outdoor work areas and the like comprising upper and lower tubular members within which bypassing non-communicating combustion and air passages are defined for progressively heating the air from the intake end to the discharge thereof. The combustion passage includes a fire tube and an exhaust chamber while the air passage includes a preheating chamber generally coextensive with the exhaust chamber an a final heating chamber generally coextensive with the fire tube.

Whitaker, U.S. Pat. No. 2,494,113 discloses improvements in furnaces used for the heating of buildings. In particular Whitaker teaches the introduction of the flame on a chord, i.e. the flame enters tangentially. He also discusses the notion of providing a spiral baffle plate which in effect directs the gases of combustion in a helical path around a plurality of four or more flues. The air to be heated enters the flues from an intake manifold passes through the flues being heated by the combustion gases and then passes into a hot air manifold at the top of the furnace for distribution by conventional means to the spaces to be heated.

Hoesman, U.S. Pat. No. 764,191 discloses a spiral draft configuration. The combustion gases are conveyed through pipes having a spiral arrangement. The spiral arrangement of the pipes induces a spiral draft, which he contends as being very effective in keeping up a rapid combustion. The air being heated ascends through the casing and the coiled pipes and is thoroughly and quickly heated by the hot combustion gases.

SUMMARY OF THE INVENTION

Basically the present invention in it's most simple form or embodiment is directed to a heat exchanger which provides for at least two heat exchange surfaces and which has the combustion of the fuel, which generates the heat, take place within the heat exchanger rather than the heat of combustion being introduced into the exchanger from an external combustion chamber and wherein the flame is directed into an opening of a truncated cone which cone has a shape approximating the shape of the flame and wherein the tips or ends of the flame "play" on an arcuate surface which is in thermal energy transfer communication with fluid to be heated which is at the unheated or ambient temperature. Additionally, note that the fluid, air in the case of a hot air system, is introduced into the passages where heat exchange will take place, and directed toward the hottest region of the combustion chamber. That is, the coldest air comes into thermal contact with the hottest region providing for maximum heat exchange. The flame is introduced into the combustion chamber in a direction which is essentially parallel to the axis of the cylindrical device. As a consequence the flame does not impinge onto any substantially flat or planar surface. Because of the nature of the construction of the nozzle etc., the flame forms into a cone configuration allowing thorough mixture with the combustion air and thus providing for complete and efficient combustion. The structural details and the pressures that are developed within the combustion chamber and the combustion region, cause the flame to "play" along the conically configured walls of the truncated portion defining the combustion chamber and to impinge onto the curve/arcuate surface which conductively transfers heat to the air or fluid entering the first heat exchange volume or space. The heat of the combustion gases is given up to the fluid in basically five (5) heat exchange volumes of the device.

It is a primary object of the present invention to provide a heat exchange device for heating a fluid comprising: a housing member; a coaxial heat exchange member in space relationship with the housing member and a fluid flow directing member in spaced relationship with the coaxial heat exchange member. The spacial relationship of the members are such that there is defined within the combination of members, five (5) heat exchange volumes or spaces provided for the flow of fluid which flow is turbulent proximate the heated surfaces. The coaxial heat exchange member defines a combustion chamber and a combustion gas space in communication with a means for exhausting the gases of combustion.

It is another primary object of the present invention to provide a heat exchange device for heating a fluid comprising: a housing member having a shell portion, a fluid input aperture defined by a fluid input end of the shell portion, an output end cover plate sealably attached to the shell portion at an end opposite the fluid input end and with a burner assembly aperture defined therein, a fluid output portal radially directed and disposed at the output end; a coaxial heat exchange member having an outer shell portion, a truncated portion defining a combustion chamber therein with a combustion chamber input portal, the truncated portion contiguous with the outer shell portion, an inner shell portion having an arcuate surface, a fluid aperture at an end opposite the arcuate surface, the inner shell and the arcuate surface defining a first heat exchange region within the inner shell and the inner shell disposed within the outer shell in spaced relationship so as to create, along with the truncated portion and a combustion gas output end cover, the combustion chamber and a combustion gas space which space is in gas communication with a combustion gas exhaust portal, the coaxial heat exchange member disposed within the housing member such that; the combustion chamber input portal is aligned with and proximate to the burner assembly aperture and; the coaxial heat exchange member outer shell portion, the housing member shell portion, the output end cover plate and the truncated portion in combination defines a fourth and a fifth heat exchange volume; and a fluid flow directing member in spaced relationship with the coaxial heat exchange member, having an outer and an inner shell in spaced relation the inner shell disposed within the first heat exchange region so as to define a first and a second heat exchange volume from the first heat exchange region, the first volume being the region defined by the arcuate surface and an output end of the inner shell of the fluid flow directing member, the output end opposite a fluid input end, the fluid input end having an end cover affixed to the outer shell and defining a first fluid opening aligned and in flow communication with a first fluid flow space defined by the inner shell, the end cover and the outer shell disposed, relative to the housing member shell portion to define a second fluid flow space, and relative to the coaxial heat exchange member outer shell portion and the combustion gas output end cover, a third heat exchange volume. Typically the fluid being heated is air although water for example could be heated since there is complete lack of communication between the combustion region or passage and the passage or region through which the fluid being heated travels and takes on the heat from the combustion region or passage.

Yet another primary object of the present invention to provide a heat exchange device having a refractory material placed on the arcuate surface and wherein in the coaxial heat exchange member outer shell portion, inner shell portion and the fluid flow directing member outer and inner shell are cylindrically configured with appropriately sized diameters to define, when the coaxial heat exchange member and the fluid flow directing member are in such a spaced relationship, the first, second and third heat exchange volumes and the truncated portion is conically configured having appropriately sized diameters to mate with the burner assembly aperture and the coaxial heat exchange member outer shell portion. Further, the housing member shell portion may be cylindrically configured to have disposed therein the coaxial heat exchange member which, in turn has contained therein the fluid flow directing member and the dimensions, in combination with the coaxial heat exchange member outer shell portion and the truncated portion also appropriate to define the third, fourth and fifth heat exchange volumes and in combination with the fluid input end of the shell portion of the housing member the second fluid flow space.

A still further primary object of the present invention to provide a heat exchange device further comprising a means for viewing the flame in the combustion chamber and the means for viewing, sealingly attached to the housing member and the truncated portion to permit viewing of the combustion chamber. Further, there may be provision for incorporation of a pressure relief assembly in combination with the viewing means for release of excess pressure from the combustion chamber.

A further object of the present invention is to provide a heat exchange device is contained within a tank containing a fluid to be heated. The tank, such as a hot water tank, having a fluid in means, a fluid out means and aperture means for peripherally sealing the exhaust gas means or the exhaust/flue tube and the flame introducing means such as an oil burner unit.

A still further object of the present invention is to provide a heat exchange device which can be easily and completely cleaned by being able to simply remove the burner assembly which may be latchingly and hingeingly mounted to the output end cover plate disposed to introduce a flame into the combustion chamber at the combustion chamber input portal and thereby enhance accessibility to the combustion chamber and combustion region for ease of complete cleaning. Associated with this object is the further object of providing a heat exchange unit capable of burning as the fuel for combustion, waste oil products. Such ability to burn waste oil and waste oil products due in part to the ease of cleaning of the combustion chamber and region and in part due to the geometry of the combustion chamber and the arcuate surface and the chordal direction of the flame.

These and further objects of the present invention will become apparent to those skilled in the art after a study of the present disclosure of the invention and with reference to the accompanying drawings which are a part hereof, wherein like numerals refer to like parts throughout, and in which:

DESCRIPTION OF THE PREFERRED EMBODIMENTS

Figure 1:
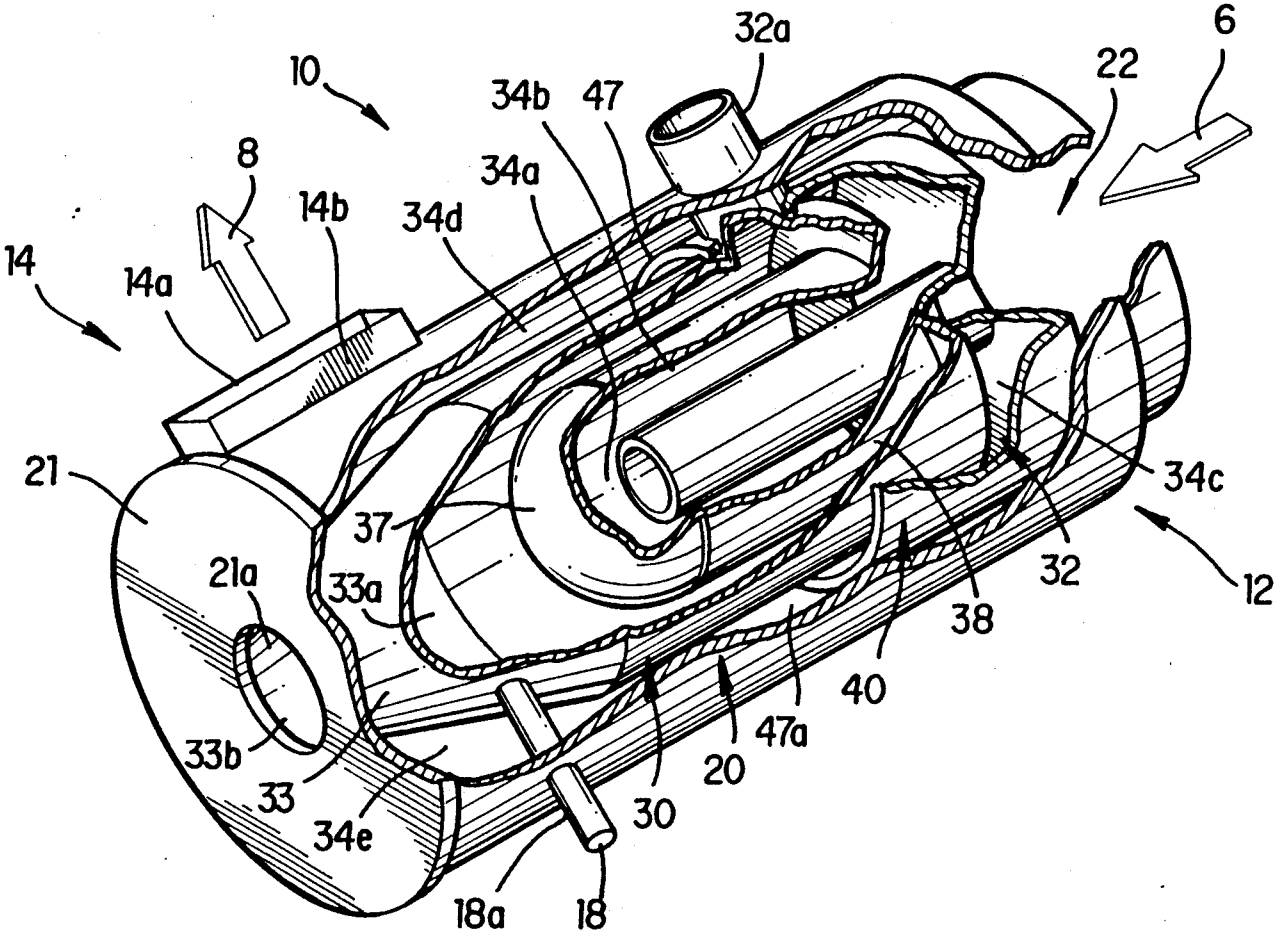
FIG. 1 is a perspective view of the heat exchange device having cutaway sections to illustrate the respective locations of some of the various elements and spaces of the instant invention.
Figure 2:
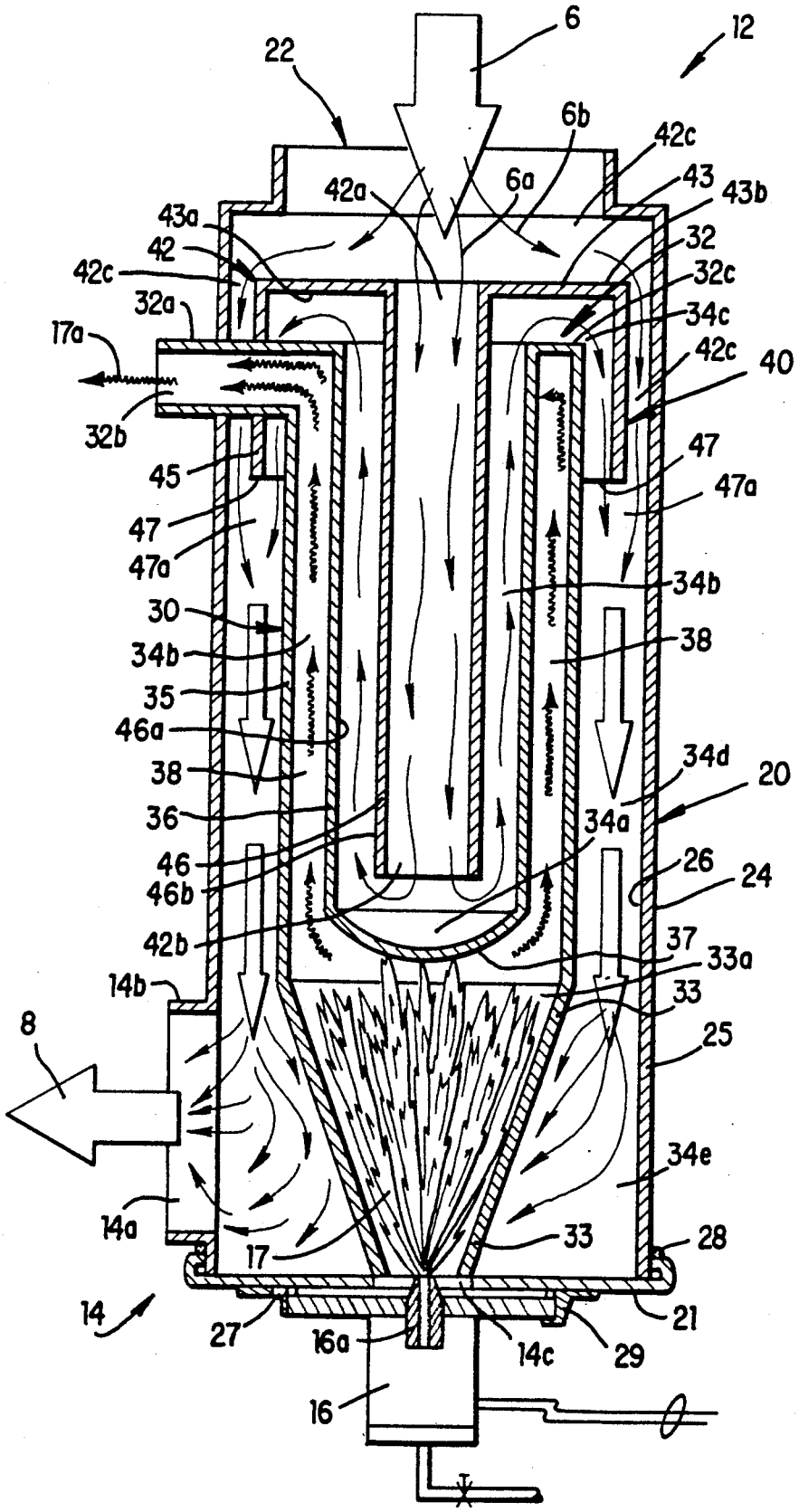
FIG. 2 is a cross-sectional view illustrating the flame, the combustion gas flow, the flow paths of the fluid to be heated and the five heat exchange volumes.
Figure 4:
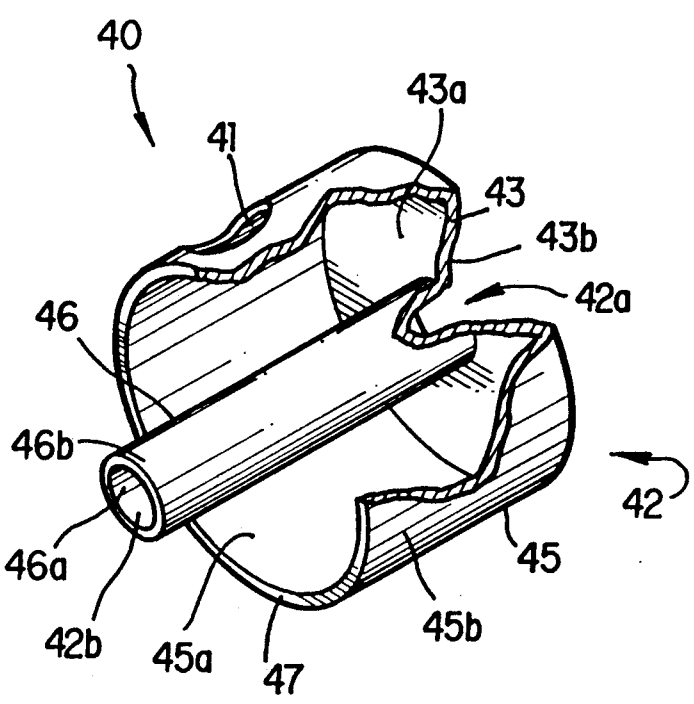
FIG. 4 is a perspective view, with cutaways, of the fluid flow directing member.
Figure 3:
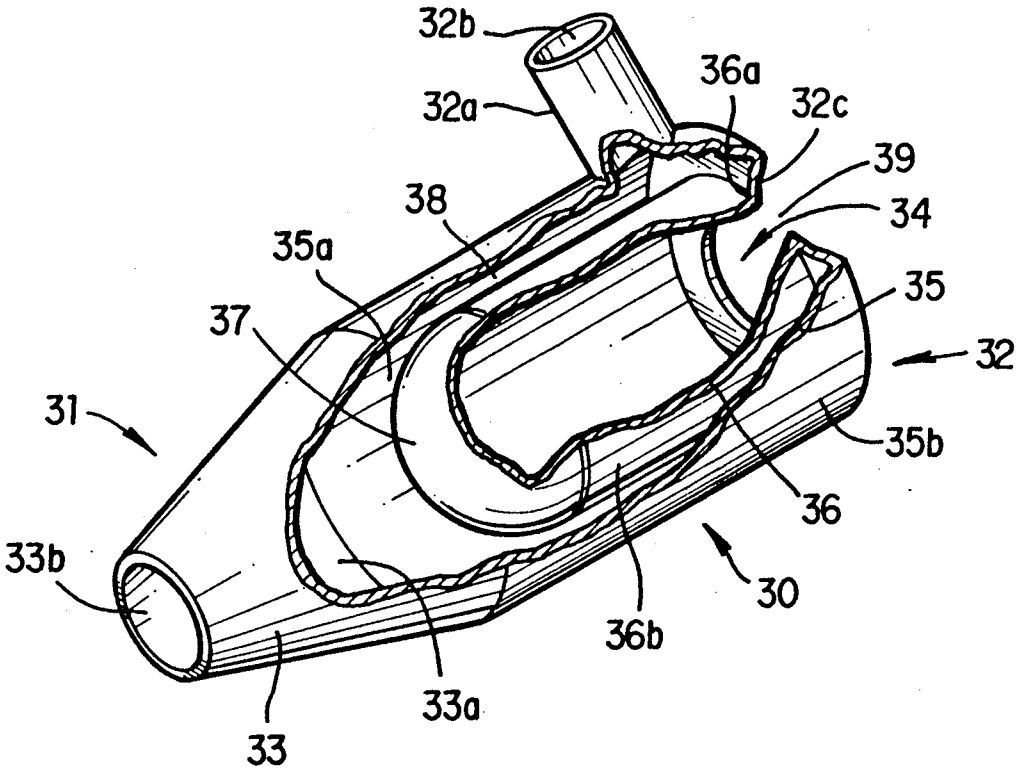
FIG. 3 is a perspective view of the coaxial heat exchange member with cutaway sections to illustrate the various elements and spaces of the invention.

For the sake of brevity, clarity, and simplicity I shall not describe in detail those familiar parts which have long been constituents of furnaces, such as; hot air systems, fans or air blower assemblies, burner units and their associated components such as pilots, or electrodes and atomizing nozzles, control systems for controlling temperatures of stacks or of the region being heated or of the medium or fluid being heated etc. These constituents or elements of systems in which the heat exchanger of the instant invention may be used, are well known to those of ordinary skill in the heat exchanger/heater/furnace art. It is also understood that components or constituents such as air filters, fuel oil filters, fuel lines, power supplies and the like will be assumed to be incorporated within the system as is deemed to be appropriate for those systems using the heat exchanger of the present invention. Further, for the sake of explanation the fluid described will be in most instances air. Also, because the device may be scaled to provide for small or large systems capable of generating various levels of thermal energy, the dimensions of the heat exchange device is not fixed. However, the members have dimensions all of which are related one to the other so that upon assembly of the members to obtain the device, properly sized spaces and volumes and apertures and flow paths are defined.

It is also understood that while the present invention may be positioned in various ways such as where the shells or tubes are vertically oriented or horizontally oriented, it may not or should not be used within a system where the exhaust gases output portal is (in a horizontal plane) below the burner assembly mounting tube or means.

The construction of the heat exchanger device 10 will first be described with reference to FIGS. 1–4 collectively. The device 10 is substantially comprised of three (3) fundamental components or members; a housing member 20, a coaxial heat exchange member 30 and a fluid flow directing member 40. These three members 20, 30 and 40 are sized relative to each other and assembled in space relationship so as to define a combustion chamber 31*a*, combustion gas region 38 and heat exchange volumes 34*a*, 34*b*, 34*c*, 34*d*, 34*e* and the paths which fluid to be heated 6 takes through device 10 and the paths which are taken by the hot combustion gases 17*a*. The spaced relationship and the volumes and spaces so defined by the novel combination of the three members result is highly efficient thermal energy transfer from the hot combustion gases 17*a* to the fluid 6. Gases 17*a*, when the device 10 is in operation, are flowing through combustion gas region/space 38 from the combustion chamber 31*a* toward the combustion chamber output end 32 and through portal 32*b* to be exhausted by chimney or other means. Thermal energy is transferred to the fluid 6 which is in heat exchange communication with gases 17*a* through the walls of the various elements such as the inner shell 36 of member 30, the combustion chamber output end cover 32*c*, the outer shell 35 of member 30 and the truncated section 33 of member 30. The incoming air 6 enters at the air input aperture 22 which is at the input end 12 of device 10. The heated fluid 8 exits device 10 through the heated air output portal 14*a* and the heated air exhaust tube 14*b* which is located at the air output end 14.

The housing member 20, in the preferred embodiment, is cylindrical. There is an outer shell 25 which has an inner surface or skin 26 and an outer surface 24. At one end of member 20 is located an air input aperture 22 and at the opposite end there is an output end cover plate 21 which is securely attached to the periphery of shell 25 and sealed by means of seal 28. Approximately in the center of the cover plate 21 is a burner assembly aperture or portal 21*a* which is dimensioned and provisioned to permit mounting of a burner assembly 16 and nozzle 16*a*. Assembly 16 may be mounted by a hinge means 27 and latching means 29 so that the burner and nozzle 16 and 16*a* may be easily moved permitting assess to the combustion chamber 33*a* and combustion gas region 38. At the hot air output end 14 is located portal 14*a* and tube 14*b* to radially direct the heated air 8.

The coaxial heat exchange member 30, in the preferred embodiment, is cylindrical as are the outer shell portion 35 and the inner shell portion 36. The outer shell portion 35 has an inner surface or skin 35*a* and an outer skin 35*b*. The inner shell portion 36 likewise has an inner surface or skin 36*a* and an outer skin 36*b* and is located concentrically within outer shell portion 35. At the combustion gas output end 32 there is a combustion gas output end cover 32*c* having an outside diameter about equal to the diameter of the outer shell 35 and having a fluid/air aperture 39 located centrally with a diameter about equal to the diameter of the inner shell portion 36. The combustion gas end cover outer diameter edge and the edge defined by the aperture 39 are securely and, sealingly affixed to the outer shell portion and inner shell portion 35 and 36 at the combustion gas output end 32. A combustion gas portal 32*a* along with combustion gas exhaust tube 32*a* are located at the output end 32 and are in gas communication with a combustion gas region 38 which region is defined by the difference in the diameters of the inner and outer shell portion 36 and 35. An arcuate surface 37 is, sealingly attached to the end of the inner shell portion opposite aperture 39. The arcuate surface 37 and the inner skin 36*a* define a first heat exchange region 34.

A truncated cone portion 33 defines a combustion chamber 33*a* therein. A combustion chamber input portal 33*b* is at the combustion chamber input end 31 of truncated cone portion 33. The diameter of the portal 33*b* is about equal to the diameter of the burner flame portal 14*c* and combustion chamber input end 31 is, sealingly engaged with output end cover plate 21 with portals 33*b* and 21*a* forming the burner flame portal 14*c*. The truncated portion 33 is contiguous with and sealingly affixed to the outer shell portion 35. The space defined by the interior of the combination of the truncated portion 33, the outer shell portion 35, the inner shell portion 36, the combustion gas output end cover 32*c* and the combustion gas exhaust tube 32*a*, contains the combustion flame 17 and the combustion gas 17*a* and maintains 17 and 17*a* separate from the air 6 which becomes heated air 8.

A fluid flow directing member 40 is in spaced relationship with the coaxial heat exchange member 30 so as to define from the first heat exchange region 34, a first, a second and a third heat exchange volumes 34*a*, 34*b*, and 34*c*. The fluid flow directing member 40, in the preferred embodiment, has a cylindrical outer and inner shell 45 and 46 respectively. The outer shell 45 has an inner surface or skin 45*a* and an outer skin 45*b*. The inner shell 46 likewise has an inner surface or skin 46*a* and an outer skin 46*b* and is located concentrically within outer shell 45. At the air input end 42 there is an air input end cover 43 with an inner surface 43*a* and an outer surface 43*b* and having an outside diameter about equal to the diameter of the outer shell 45 and having a first air portion aperture 42*a* located centrally with a diameter about equal to the diameter of the inner shell 46. The air input end cover 43 outer diameter edge and the edge defined by the aperture 42*a* are securely and, sealingly affixed to the outer shell and inner shell 45 and 46 at the air input end 42. In the outer shell 45 there is located an exhaust tube aperture 41 to accommodate exhaust tube 32*a* when the members are assembled to form the device 10. The location of aperture 41 is such that when member 40 is disposed within members 30 and 20, the heat exchange volumes and the air flow paths are all defined.

The inner shell 46 has a first air output end 42*b* opposite the aperture 42*a*. Output end 42*b*, when member 40 is properly disposed within member 30, is positioned close to the inner skin of arcuate surface 37 creating the so-called first heat exchange volume 34*a*. The outer surface 46*b* and the inner surface 36*a* of the inner shell 36 of member 30 combine to define the second heat exchange volume 34*b*. The inner surface 43*a* of the air input end cover 43 and the combustion gas output end cover 32*c* along with the inner surface 45*a* of the outer shell 45 and the portion of the outer surface 35*b* of the outer shell 35 of member 30 near to the air aperture 39, combine to define the third heat exchange volume 34*c*. The outer surface 43*b* of the air input end cover 43 and the outer surface 45*b* of outer shell 45 combine with the inner surface 26 of the housing shell 25 to define a second air portion passage 42*c* into which and through which the second portion of air 6*b* is directed and through which it flows.

The coaxial heat exchange member 30, having the air flow directing member 40 disposed therein, is disposed within housing member 20 such that the combustion chamber input portal 33*b* is aligned with and proximate to the burner assembly aperture 21*a* and the coaxial heat exchange member outer shell portion 35, the housing member shell portion or outer shell 25, the output end cover plate and said truncated portion in combination defines a fourth and a fifth heat exchange volume 34*d* and 34*e* respectively.

The arcuate surface 37 may be covered with a refractory material to reduce, by dispersal, to an acceptable level the concentrated temperature of the arcuate surface 37. A so-called viewing portal 18 and viewing tube 18*a* are shown in FIG. 1. The viewing portal 19 may also be provided with a safety pressure release apparatus which would release excess pressure from the combustion chamber 33*a*. The viewing portal 19 may be appropriately positioned anywhere on the outer shell 25 of the housing member 20 to permit the viewing of the condition of flame 17 in order to make adjustments to the burner assembly 16 to improve the burning efficiency of the combustion.

The operation of and the advantages of the heat exchanger 10 being used as the heat exchanger portion and the combustion chamber portion of a hot air furnace or hot air heater assembly will now be described with reference to FIGS. 1–4.

In operation, inlet air 6 is heated and discharged as heated air 8. The flame 17 emanates from the burner assembly 16 from a nozzle or jet of ordinary type 16*a*. The burner assembly 16 is mounted so as to direct the flame 17 into the combustion chamber 33*a* which has a shape approximating the shape of the flame 17 thereby resulting in a fairly uniform heating of the surfaces of the truncated cone 33. The heat applied to the cone 33 is conducted into heat exchange volume 34*e*. The flame 17 also impinges onto the arcuate surface 37 which heat in then conducted into heat exchange volume 34*a*. The hot combustion gases 17*a* travel through combustion gas region 38 giving up heat to the surfaces 35*a* and 36*b* of member 30. This heat is conducted into the second heat exchange volume 34*b* and into the fourth heat exchange volume 34*d*. The combustion gases are exhausted through portal 32*b*.

The cool air 6 enters the heat exchanger 10 at the air input aperture 22. A first portion 6*a*, approximately one-half of the total air 6 is directed into the first air portion input 42*a* and the remainder of air 6, a second portion 6*b*, is directed toward and into the second air portion passage 42*c*. The portion of air 6*a* is drawn or forced down the center of the inner shell 46 and against the interior surface of the arcuate surface 37 and the first heat exchange volume 34*a* where air 6*a* takes on some of the heat that has been transferred to volume 34*a*. Air 6*a* is then directed into volume 34*b* taking on additional heat and on into volume 34*c* where there is again a 180° direction change into the region between the inner surface 45*a* of member 40 and the outer surface 36*b* of member 30. As air 6*a* emerges from this region it has been warmed considerably and upon reaching the lower peripheral edge 47 of the outer skin 45, it combines in a very turbulent way at air mixing space 47*a* with air 6*b* which has not been warmed and which has traveled a much shorter distance. The temperature difference of air streams 6*a* and 6*b* and the difference in the velocities of the air creates not only the turbulence throughout the fourth heat exchange volume 34*d* as the combined air 6*a* and 6*b* moves toward the air output end 14 but there is also a partial vacuum created at mixing space 47*a* which tends to forcefully draw air 6*a* into aperture 42*a* and causes increased turbulence (and thus better heat exchange) in the first heat exchange volume 34*a* where the air 6*a* makes a 180° direction change. The combined air 6*a* and 6*b* further becomes turbulent at the very hot surface of the truncated cone 33. While the combined air 6*a* and 6*b* has been heated in passing through volumes 34*a*, 34*b*, 34*c* and 34*d*, it takes on additional heat in the fifth heat exchange volume 34*e* from the very hot cone 33. There is also considerable turbulence in volume 34*e* because of the geometry of the cone 33 and the temperature difference between the combined air 6*a* and 6*b* entering volume 34*e* and the temperature of cone 33. The air 6*a* and 6*b* takes on more heat and is exhausted as hot air 8 radially through the heated air output portal 14*a* and tube 14*b*.

The heat exchanger 10 of the present invention may be secured within a tank, such as a hot water tank. The tank could be designed so that there was sealing around the exhaust tube 32*a*, the burner flame portal 14*c* and the viewing tube 18*a*. There would also be provided a cold water-in fitting and a hot water-out fitting mounted on the tank. Provision would be made for controlling the temperature of the water. The heat exchange device 10 could be mounted in a vertical or a horizontal attitude within the tank. Water need only be made to flow over or surround the surfaces which define all of the heat exchange volumes of the device 10. The heat exchanger 10 could also be used in a tankless type hot water heater. The heat exchange device 10 could be mounted within the tank in any attitude so long as the burner portal 14*c* is not above the exhaust portal 32*b*.

Ordinary and conventional burner assemblies 16, control systems, heated air directing assemblies, such as air ducts, air blowers and the like, may be used with the hot air heater or hot water heater assemblies incorporating the heat exchanger 10.

It is understood that the device as illustrated and described herein may have different dimensions and variations of the illustrated basic geometry and may have different attitudes within the system wherein the instant device is being used. It is also understood that the device can be scaled up or down to provide for more or less BTU's of heat respectively. It is also thought that the heat exchange device of the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

I claim:

1. A heat exchange device for heating a fluid comprising:

a housing member having a shell portion, a fluid input aperture defined by a fluid input end of said shell portion, an output end cover plate sealably attached to said shell portion at an end opposite said fluid input end and with a burner assembly aperture defined therein, a fluid output portal radially directed and disposed at said output end;

a coaxial heat exchange member having an outer shell portion, a truncated portion defining a combustion chamber therein with a combustion chamber input portal, said truncated portion contiguous with said outer shell portion, an inner shell portion having an arcuate surface, a fluid aperture at an end opposite said arcuate surface, said inner shell and said arcuate surface defining a first heat exchange region within said inner shell and said inner shell disposed within said outer shell in spaced relationship so as to create, along with said truncated portion and a combustion gas output end cover, said combustion chamber and a combustion gas space, said combustion gas space being an annulus defined by an inner surface of said outer shell portion and an outer surface of said inner shell portion, and which space is in gas communication with a combustion gas exhaust portal, said coaxial heat exchange member disposed within said housing member such that; said combustion chamber input portal is aligned with and proximate to said burner assembly aperture and; said coaxial heat exchange member outer shell portion, said housing member shell portion, said output end cover plate and said truncated portion in combination defines a fourth and a fifth heat exchange volume; and a fluid flow directing member in spaced relationship with said coaxial heat exchange member, having an outer and an inner shell in spaced relation said inner shell disposed within said first heat exchange region so as to define a first and a second heat exchange volume from said first heat exchange region, said first volume being the region defined by said arcuate surface and an output end of said inner shell of said fluid flow directing member, said output end opposite a fluid input end, said fluid input end having an end cover affixed to said outer shell and defining a first fluid opening aligned and in flow communication with a first fluid flow space defined by said inner shell, said end cover and said outer shell disposed, relative to said housing member shell portion to define a second fluid flow space, and relative to said coaxial heat exchange member outer shell portion and said combustion gas output end cover, a third heat exchange volume said housing member, said coaxial heat exchange member and said fluid flow directing member, in combination defining a fluid flow path from said fluid input aperture to said fluid output portal and said combustion chamber and said combustion gas space separate from said fluid flow path.

2. The heat exchange device according to claim 1 wherein said fluid being heated is air.

3. The heat exchange device according to claim 2 further comprising a refractory material placed on said arcuate surface.

4. The heat exchange device according to claim 3 wherein said coaxial heat exchange member outer shell portion, inner shell portion and said fluid flow directing member outer and inner shell are cylindrically configured with appropriately sized diameters to define, when said coaxial heat exchange member and said fluid flow directing member are in said spaced relationship, said first, second and third heat exchange volumes and said truncated portion is conically configured having appropriately sized diameters to mate with said burner assembly aperture and said coaxial heat exchange member outer shell portion.

5. The heat exchange device according to claim 4 wherein said housing member shell portion is cylindrically configured to have disposed therein said coaxial heat exchange member which, in turn has contained therein said fluid flow directing member and said dimensions, in combination with said coaxial heat exchange member outer shell portion and said truncated portion also appropriate to define said third, fourth and fifth heat exchange volumes and in combination with said fluid input end of said shell portion of said housing member said second fluid flow space.

6. The heat exchange device according to claim 5 further comprising a means for viewing said flame in said combustion chamber and said means for viewing, sealingly attached to said housing member and said truncated portion to permit viewing of said combustion chamber.

7. The heat exchange device according to claim 6 wherein said means for viewing said flame in said combustion chamber further comprises means for release of excess pressure from said combustion chamber.

8. The heat exchange device according to claim 7 further comprising a burner assembly latchingly and hingeingly mounted to said output end cover plate disposed to introduce a flame into said combustion chamber at said combustion chamber input portal.

9. The heat exchange device according to claim 7 wherein said device is contained within a tank containing a fluid to be heated said tank having a fluid in means, a fluid out means and aperture means for peripherally sealing an exhaust gas tube and said burner assembly aperture.

10. A heat exchange device for heating a fluid comprising: a housing member; a coaxial heat exchange member in space relationship with said housing member said coaxial heat exchange member defining a combustion chamber and a combustion gas space in communication with a means for exhausting the gases of combustion; and a fluid flow directing member in spaced relationship with said coaxial heat exchange member said spacial relationships of said members are such that there is defined within the combination of said members, five (5) heat exchange volumes or spaces provided to accommodate a flow of fluid which flow is turbulent proximate said combustion chamber and said combustion gas space said housing member, said coaxial heat exchange member and said fluid flow directing member, in combination defining a fluid flow path from a fluid input end through said heat exchange device to an output end of said heat exchange device and said combustion chamber and said combustion gas space separate from said fluid flow path.

* * * * *